US006978515B2

(12) United States Patent
Noguchi et al.

(10) Patent No.: US 6,978,515 B2
(45) Date of Patent: Dec. 27, 2005

(54) BALANCING DEVICE OF RAISING-LOWERING WINDOW

(75) Inventors: Norio Noguchi, Chiyoda-ku (JP); Toshiyuki Fukuzawa, Chiyoda-ku (JP)

(73) Assignee: Meiko Co., Ltd., Osaka (JP)

( * ) Notice: Subject to any disclaimer, the term of this patent is extended or adjusted under 35 U.S.C. 154(b) by 17 days.

(21) Appl. No.: 10/671,042

(22) Filed: Sep. 25, 2003

(65) Prior Publication Data

US 2005/0066473 A1 Mar. 31, 2005

(51) Int. Cl.[7] ..... E05F 1/00
(52) U.S. Cl. ..... 16/193; 16/197; 49/181
(58) Field of Search ..... 16/193, 197, 440, 16/401, DIG. 1, DIG. 16, 195, 201, 198; 49/445, 446, 447, 174–176, 181; 160/190–192, 160/170, 172 R, 172 V

(56) References Cited

U.S. PATENT DOCUMENTS

| | | | | | |
|---|---|---|---|---|---|
| 2,477,069 | A | * | 7/1949 | Larson | 16/197 |
| 2,604,655 | A | * | 7/1952 | Peremi | 16/197 |
| 2,622,267 | A | * | 12/1952 | Peremi | 16/197 |
| 2,637,875 | A | * | 5/1953 | Hess | 16/197 |
| 2,774,100 | A | * | 12/1956 | Larson et al. | 16/197 |
| 2,792,588 | A | * | 5/1957 | Gency | 16/197 |
| 2,792,589 | A | * | 5/1957 | Young | 16/201 |
| 2,825,089 | A | * | 3/1958 | Larson et al. | 16/197 |
| 2,851,721 | A | * | 9/1958 | Decker et al. | 16/197 |
| 3,699,608 | A | * | 10/1972 | Schwarz | 16/79 |
| 5,383,303 | A | * | 1/1995 | Nakanishi et al. | 49/181 |
| 5,697,188 | A | * | 12/1997 | Fullick et al. | 49/181 |
| 5,937,478 | A | * | 8/1999 | Regnier | 16/78 |

FOREIGN PATENT DOCUMENTS

| | | | | | |
|---|---|---|---|---|---|
| GB | 2373813 | A | * | 10/2002 | E04C 2/34 |
| GB | 2379237 | A | * | 3/2003 | E05F 1/00 |
| JP | 3-161683 | | | 7/1991 | |
| JP | 3-180683 | | | 8/1991 | |
| JP | 4-238984 | | | 8/1992 | |
| JP | 2001055861 | A | * | 2/2001 | E05F 1/16 |
| JP | 2001152735 | A | * | 6/2001 | E05F 1/16 |
| JP | 2002081259 | A | * | 3/2002 | E05F 1/16 |
| JP | 2003049578 | A | * | 2/2003 | E05F 1/16 |

* cited by examiner

*Primary Examiner*—Chuck Y. Mah
(74) *Attorney, Agent, or Firm*—Jordan and Hamburg LLP

(57) ABSTRACT

A balancing force adjusting device for a window which raises and lowers includes a case, a horizontal gear member, a click member and a vertical gear member. The horizontal gear member is rotatably arranged around the horizontal axis in a predetermined position with this case, and a ratchet gear is formed around a shaft portion of the horizontal gear member. The click member is rotatably arranged in a predetermined angular range around the horizontal axis in a position adjacent to the horizontal gear member, and has two clicks extending in the horizontal gear member direction and respectively arranged on both the sides of an intermediate shaft portion. The vertical gear member is engaged with the horizontal gear member. One side click of the click member is biasedly engaged with the ratchet gear formed in the horizontal gear member. When the engagement of this one side click is released by a swinging operation, the other side click is engaged with the ratchet gear so that a torsion spring can be unwound every one gear.

11 Claims, 12 Drawing Sheets

BALANCING DEVICE OF RAISING-LOWERING WINDOW

BACKGROUND OF THE INVENTION

1. Field of the Invention

The present invention relates to a balancing device of a raising-lowering window having a movable shoji opened and closed in the vertical direction.

2. Description of Related Art

In the raising-lowering window for opening and closing the shoji in the vertical direction, a structure having a balancing device for holding a dynamic balancing relation with the shoji weight with respect to the above shoji is arranged so as to simply raise and lower the shoji by slight force and rest the shoji in an arbitrary opening position is known. This balancing device is a device devised so as to apply balancing force balancing with the window shoji through a spiral rod by utilizing the torsional force of a torsion spring. For example, publicly known balancing devices are described in JP-A-3-161683, JP-A-3-180683 and JP-A-4-238984.

These inventions mainly relate to the adjustment of the above torsion spring. Concretely, an adjusting mechanism conventionally proposed is generally divided into a structure for rotating an adjusting shaft arranged in a slide device by a ratchet mechanism in only one direction, and a structure for winding a brake spring of a coil shape around an adjusting shaft and giving braking force to the adjusting shaft by the tight binding force of the brake spring.

However, in the adjusting structure using the above ratchet mechanism, it is very convenient to wind and fasten the torsion spring, but no torsion spring can be unwound. Therefore, this adjusting structure has disadvantages in that the adjustment is limited to one direction, and the torsional force of the torsion spring is released at a stretch, etc. In contrast to this, the structure utilizing the brake spring is more excellent than the structure of the above ratchet mechanism since both the winding and unwinding operations can be performed. However, there is a fearful problem with respect to the braking force using the brake spring. Therefore, problems exist in that the unwinding operation is naturally caused by a slip and slackness is caused with the passage of time so that no sufficient braking function can be maintained for a long period, etc.

Further, the adjusting shaft must be rotated against the brake spring. Therefore, problems exist in that labor taken in the adjustment is large, etc.

In comparison with the above ratchet structure and the above brake spring structure, the balancing device described in the above JP-A-4-238984 is more excellent than the other devices since the braking force is reliably obtained and the unwinding operation is simply performed by skillfully utilizing the rotating direction of the adjusting shaft and a wedge effect. However, problems exist in that the number of parts is large and the structure of a braking portion is complicated, and no stepwise adjustment can be made in the unwinding operation, etc.

Further, as mentioned above, in the case of the balancing device in which no unwinding operation can be stepwise adjusted and the torsional force of the torsion spring is completely released at a stretch, the movable shoji suddenly drops by its own weight when the torsional force of the torsion spring is released in the opening state of the movable shoji and an operator carelessly forgets to support the movable shoji. Therefore, problems exist in that the operator is accidentally injured and the shoji is damaged in certain cases, etc.

SUMMARY OF THE INVENTION

Therefore, a main object of the present invention is to provide a balancing device of a raising-lowering window having a compact structure simply assembled and able to simply make the winding and unwinding adjustments without generating the slackness, the slip, etc. at all after the adjustments, and able to make the stepwise adjustment with respect to the unwinding operation as well as the winding operation.

To solve the above problems, the invention according to a first aspect of invention provides a balancing device of a raising-lowering window arranged in a movable shoji opened and closed in the vertical direction, and holding a dynamic balancing relation with the weight of the movable shoji and resting the movable shoji in an arbitrary position and facilitating the opening and closing operations, wherein the balancing device is constructed by a balancing force adjusting device, a balancing force generator, a slide body and a spiral rod;

the balancing force adjusting device is fixedly arranged in the upper portion position of a longitudinal frame and is constructed by a case, a horizontal gear member, a click member and a vertical gear member, the horizontal gear member is rotatably arranged around the horizontal axis in a predetermined position within this case and a gear is formed on the side of a head portion of the horizontal gear member, and a ratchet gear is formed around a shaft portion of the horizontal gear member, and a screwdriver engaging portion is formed on a shaft end face of the horizontal gear member facing the case exterior, the click member is rotatably arranged in a predetermined angular range around the horizontal axis in a position adjacent to the horizontal gear member, and a screwdriver engaging portion is formed on a shaft end face of the click member facing the case exterior, and two clicks extending in the horizontal gear member direction are respectively arranged on both the sides of an intermediate shaft portion within the case, and one of the clicks is biasedly engaged with the ratchet gear formed in the shaft portion of the horizontal gear member, and the other click is engaged with the ratchet gear when the engagement of the one click is released by a swinging operation, and the vertical gear member is rotatably arranged around the vertical axis in a predetermined position within the case, and a gear engaged with the gear of the head portion of the horizontal gear member is arranged in the upper portion of the vertical gear member, and a connecting shaft is arranged in the lower end portion of the vertical gear member, and the vertical gear member is dependently rotated by rotating the horizontal gear member;

the balancing force generator is constructed by a torsion spring storing sleeve, a torsion spring stored within the torsion spring storing sleeve, and a rotating operating body arranged in the lower end portion of the torsion spring, and the balancing force generator is connected to the vertical gear member of the balancing force adjusting device and is arranged in a vertical arrangement, and at least the torsion spring is rotated and operated around the axis by an adjusting operation in the balancing force adjusting device so that balancing force can be introduced and adjusted with respect to the torsion spring and an upper direction force balancing with the movable shoji is given by the torsion spring at the opening and closing times of the movable shoji;

the slide body is fixedly arranged in a lower end side portion of the movable shoji, and is raised and lowered as the movable shoji is vertically moved; and the lower end of the spiral rod is fixed to this slide body, and the tip portion of the spiral rod extends through the rotating operating body of the balancing force generator and is inserted into the torsion spring storing sleeve, and the spiral rod performs winding and unwinding operations of the torsion spring by giving rotating force around the vertical axis to the rotating operating body as the movable shoji is vertically moved.

The present invention according to the above first aspect is a device example in which the balancing force adjusting device is arranged on the upper portion side of the balancing force generator, and the torsional force can be given by directly rotating the torsion spring of the balancing force generator on the upper portion side. Works for introducing and adjusting the initial torsional force are simply made by merely fitting a tool such as a driver, etc. to the screwdriver engaging portion of the horizontal gear member and rotating this tool. Further, the unwinding operation can be performed every one gear by reciprocating and rotating the click member by the driver, etc. at predetermined angles in the left and right directions.

Therefore, the introduced torsional force can be easily adjusted, and it is also possible to perfectly avoid a situation in which the movable shoji drops during the adjustment. Since the engagement is performed by the ratchet mechanism, there is naturally no case in which slackness, a slip, etc. are caused after the adjustment. Further, the balancing force adjusting device can be assembled by merely fitting the individual members, concretely, three members constructed by the horizontal gear member, the click member and the vertical gear member into the case, and closing the case. Therefore, the assembly is simple and the structure can be set to be very compact.

In the above invention example, the balancing force adjusting device is arranged on the upper portion side of the balancing force generator. Therefore, when the initial torsional force is introduced and adjusted, no painful working posture is forcibly required and the balancing force is easily adjusted while an operator stands near the raising-lowering window.

The invention according to another aspect of the invention provides a balancing device of a raising-lowering window arranged in a movable shoji opened and closed in the vertical direction, and holding a dynamic balancing relation with the weight of the movable shoji and resting the movable shoji in an arbitrary position and facilitating the opening and closing operations, wherein the balancing device comprises balancing means for giving an upper direction force balancing with the movable shoji by a torsion spring, slide means attached to a side portion lower end of the movable shoji and guiding the movable shoji along a longitudinal frame while guiding the movable shoji, a spiral rod for operating this slide means and the balancing means in cooperation with each other and performing winding and unwinding operations of the torsion spring of the balancing means as the slide means is moved, and adjusting means of the torsion spring assembled into the slide means;

the torsion spring adjusting means is constructed by a ratchet shaft member and a click member;

the ratchet shaft member is rotatably arranged around the vertical axis in a predetermined position, and a connecting portion connected to the spiral rod is arranged in the upper end portion of the ratchet shaft member, and a ratchet gear is formed around a shaft portion of the ratchet shaft member, and a screwdriver engaging portion is formed on a shaft lower end face of the ratchet shaft member facing the exterior, and the click member is rotatably arranged in a predetermined angular range around the vertical axis in a position adjacent to the ratchet shaft member, and a screwdriver engaging portion is formed on a shaft lower end face of the click member facing the exterior, and two clicks extending in the ratchet shaft member direction are respectively arranged on both the sides of an intermediate shaft portion, and one of the clicks is biasedly engaged with the ratchet gear formed in the ratchet shaft member, and the other click is engaged with the ratchet gear when the engagement of the one click is released by a swinging operation.

The present invention according to the above another aspect of the invention is a device example in which the torsion spring adjusting means is assembled into the slide means arranged at the side portion lower edge of the movable shoji. In the case of such a device, it is sufficient to arrange two members constructed by the ratchet shaft member and the click member. In such an invention, works for introducing and adjusting the initial torsional force are also simply made by merely fitting a tool such as a driver, etc. to the screw driver engaging portion on the lower end face of the ratchet shaft member and rotating this tool. Further, the unwinding operation can be performed every one gear by reciprocating and rotating the click member by the driver, etc. at predetermined angles in the left and right directions. Therefore, the introduced torsional force can be easily adjusted, and it is also possible to perfectly avoid a situation in which the movable shoji drops during the adjustment. Since the engagement is performed by the ratchet mechanism, there is naturally no case in which slackness, a slip, etc. are caused after the adjustment. Further, the balancing force adjusting device can be assembled by merely fitting the individual members, concretely, the click member and the ratchet shaft member into the slide means. Therefore, the assembly is simple and the structure can be set to be very compact.

Next, the present invention according to a further aspect of the invention provides the balancing device of the raising-lowering window according to any one of the aspects, wherein the other side click among the pair of left and right clicks formed in the click member is omitted, and one side click engaged with the horizontal gear member or the ratchet gear of the ratchet shaft member at all times is used.

In the invention according to this aspect, no stepwise adjustment can be made with respect to the unwinding operation. However, it is possible to obtain the effect of a compact structure simply assembled. Further, for example, in the invention according to the aspect in which the balancing force adjusting device is arranged on the upper portion side of the shoji, the indoor side shoji located on the lower stage side can be adjusted in the closing state (lowering state) of the shoji. In this case, no shoji drops even when the torsion spring force is released at a stretch. Therefore, it is sufficient even in the structure of only one side click engaged with the ratchet gear of the horizontal gear member at all times.

DESCRIPTION OF THE PREFERRED EMBODIMENTS

The embodiment modes of the present invention will next be described in detail with reference to the drawings.

First Mode Example

Figure 1:
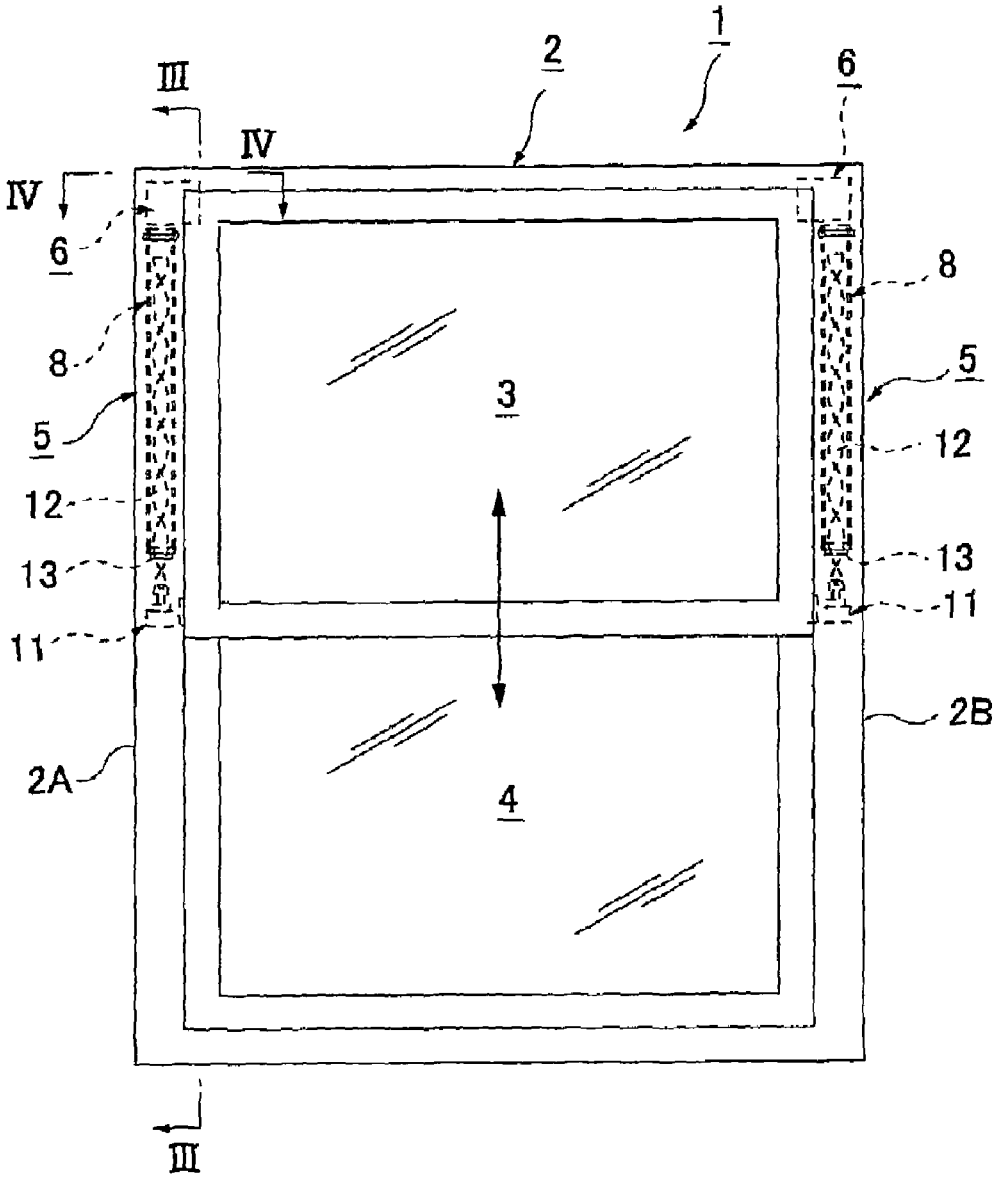
FIG. 1 is a front view of a raising-lowering window 1 having a balancing device 5.
Figure 2:
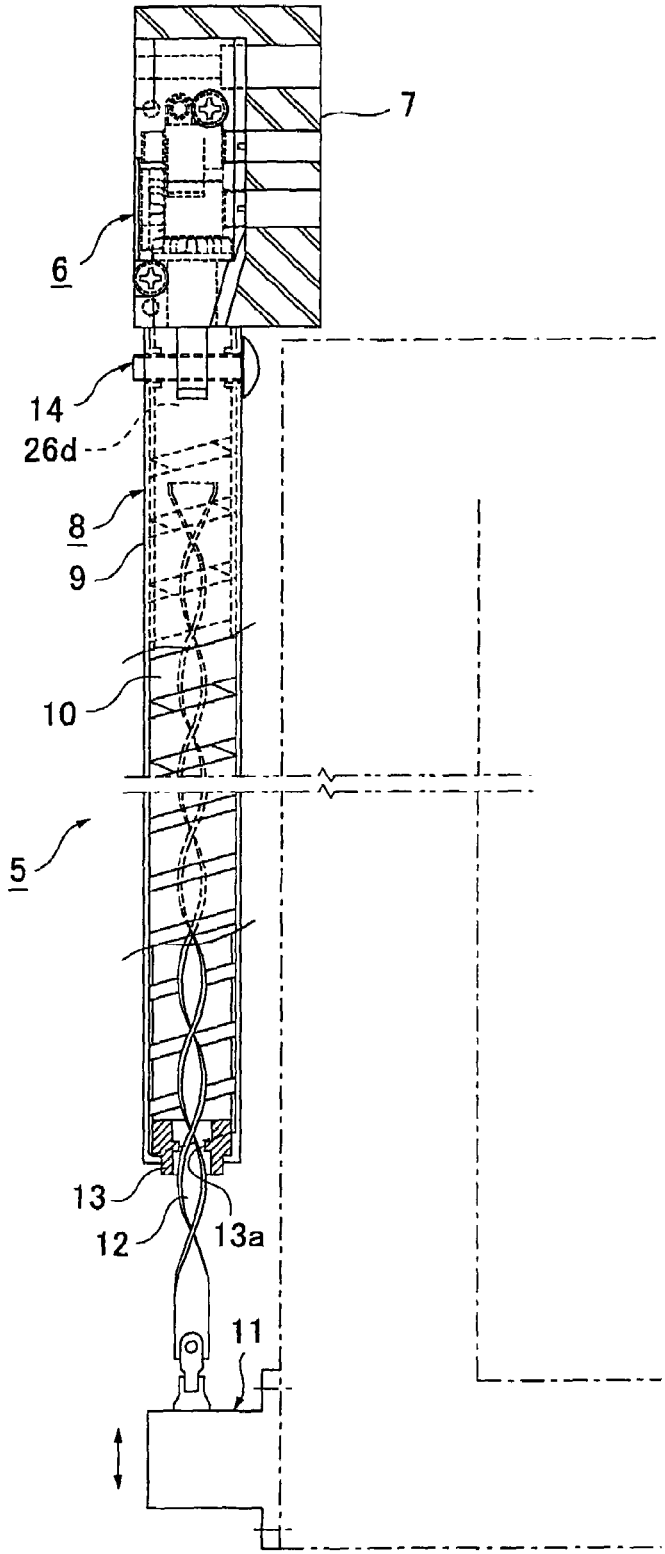
FIG. 2 is a structural view of the balancing device 5.
Figure 3:
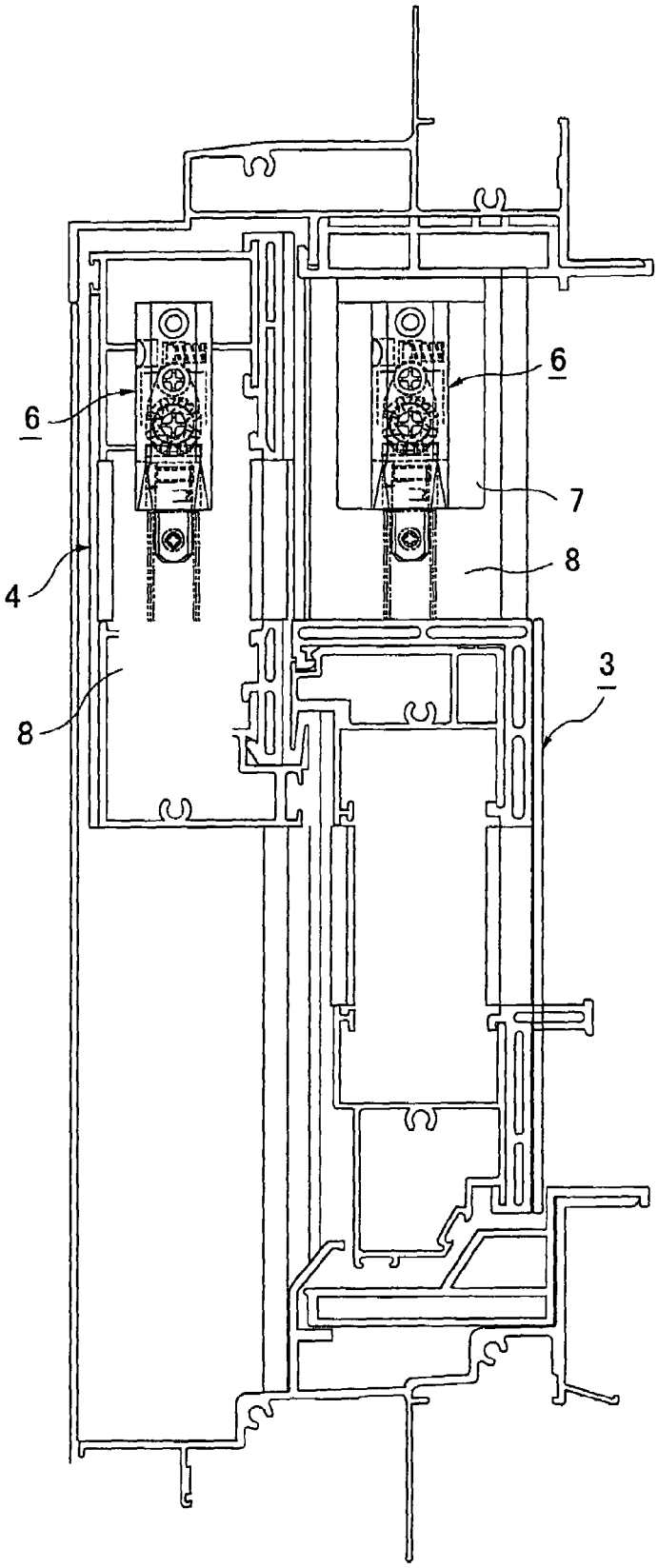
FIG. 3 is a view seen from an arrow line III—III of FIG. 1.
Figure 4:
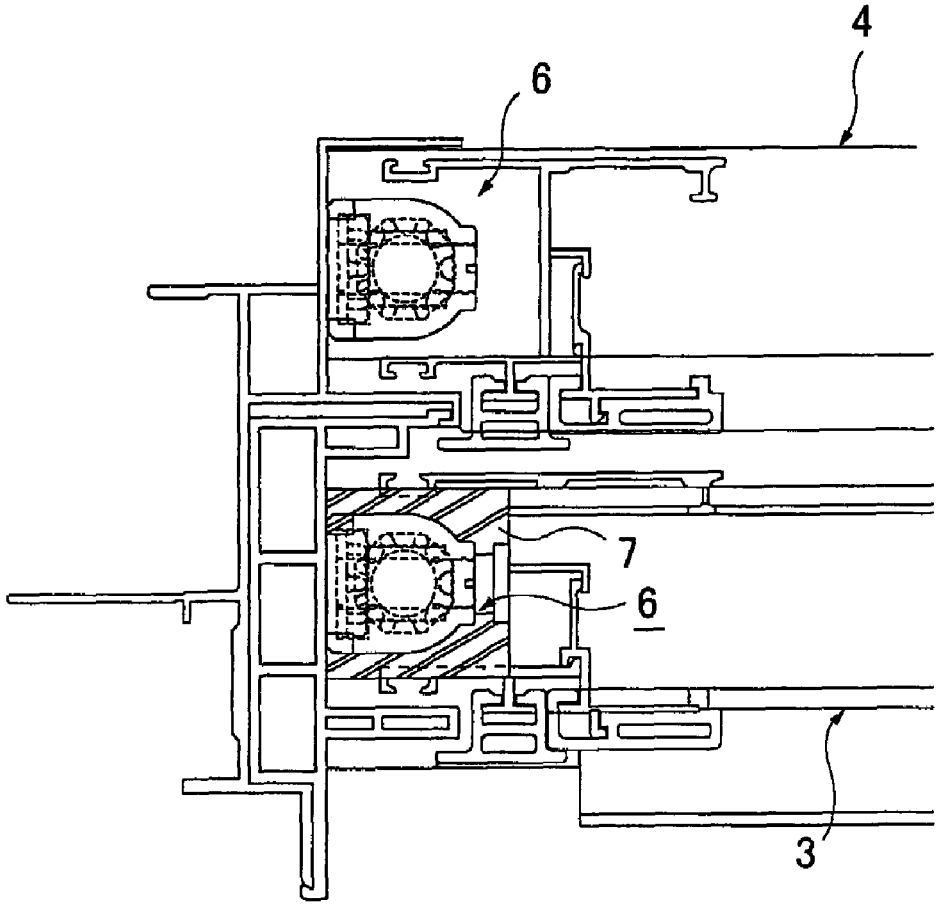
FIG. 4 is a view seen from an arrow line IV—IV of FIG. 1.

FIG. 1 is a front view of a raising-lowering window 1 having a balancing device 5. FIG. 2 is a structural view of the balancing device 5.

The raising-lowering window 1 has an inside shoji 3 and an outside shoji 4 freely raised and lowered along longitudinal frames 2A, 2B within a window frame 2. These shojis 3, 4 can be rested in arbitrary positions by balancing devices 5, 5 arranged along the interiors of the above longitudinal frames 2A, 2B. This balancing device 5 is attached to each of the inside shoji 3 and the outside shoji 4. Both the balancing devices 5, 5 differ from each other in that the length sizes of a torsion spring storing sleeve 9, a torsion spring 10 and a spiral rod 12 described later are different and a doorstop 7 freely attached and detached is arranged outside the balancing device 5 with respect to only the inside shoji 3 side. However, both the balancing devices 5, 5 have the same basic structure except for these differences. Therefore, only the balancing device 5 with respect to the inside shoji 3 (hereinafter simply called the shoji) will be explained.

As shown in FIG. 2 in detail, the above balancing device 5 is constructed by a balancing force adjusting device 6, a balancing force generator 8, a slide block 11 and a spiral rod 12. The balancing force adjusting device 6 is fixedly arranged on the upper side of the longitudinal frame 2A (2B), and adjusts balancing force. The balancing force generator 8 generates the balancing force. The slide block 11 is fixedly arranged in a lower rail side portion of the shoji 3, and is raised and lowered together with the shoji 3. The lower end of the spiral rod 12 is connected to the above slide block 11, and the tip side of the spiral rod 12 is inserted into the interior from the lower end face of the above balancing force generator 8 so as to operate this slide block 11 and the above balancing force generator 8 in cooperation with each other. The spiral rod 12 performs winding and unwinding operations of the torsion spring 10 arranged within the above balancing force generator 8 as the slide block 11 is raised and lowered.

The above balancing force adjusting device 6 will be described later. The above balancing force generator 8 will first be described. In this balancing force generator 8, the torsion spring 10 obtained by processing a spring plate of a predetermined width in a spiral shape is internally mounted to the interior of a torsion spring storing sleeve 9 hanging down from the balancing force adjusting device 6 in a vertical arrangement. A rotating operating body 13 rotated around the vertical axis in the same position by a vertical movement of the above spiral rod 12 is arranged in the lower end portion of this torsion spring 10. A slit hole 13*a* corresponding to the sectional shape of the torsion spring 10 is formed in the central portion of the above rotating operating body 13. When the above spiral rod 12 extending through this slit hole 13a is raised and lowered as the shoji 3 is vertically moved, the above rotating operating body 13 is guided and rotated by the torsional face of the spiral rod 12 so that the torsion spring 10 is wound and unwound.

In reality, as the above spiral rod 12 is lowered, the torsion spring 10 is wound by rotating the rotating operating body 13 in the winding direction. As the shoji 3 is raised, the torsion spring 10 is unwound by rotating the rotating operating body 13 in the opposite direction. Accordingly, when a balancing torsional force is given to the above torsion spring 10 in advance in a maximum raising position of the shoji 3, the torsion spring 10 balances with the shoji 3 even when the shoji 3 is located in any raising-lowering position. Accordingly, the shoji 3 can be rested in an arbitrary opening position. Further, since forces are balanced in the vertical direction, the shoji 3 can be raised and lowered and operated by slight force.

The above torsion spring storing sleeve 9 is a sleeve body approximately having a length corresponding to that of the stile of the shoji 3. The torsion spring storing sleeve 9 hangs down from the balancing force adjusting device 6 fixedly arranged in its upper end portion. The torsion spring storing sleeve 9 is rotated by an adjustment using the balancing force adjusting device 6 with the vertical axis as a rotation center together with the internally mounted torsion spring 10. Thus, an initial balancing force can be introduced and the balancing force can be thereafter adjusted by the torsion spring 10.

Figure 5:
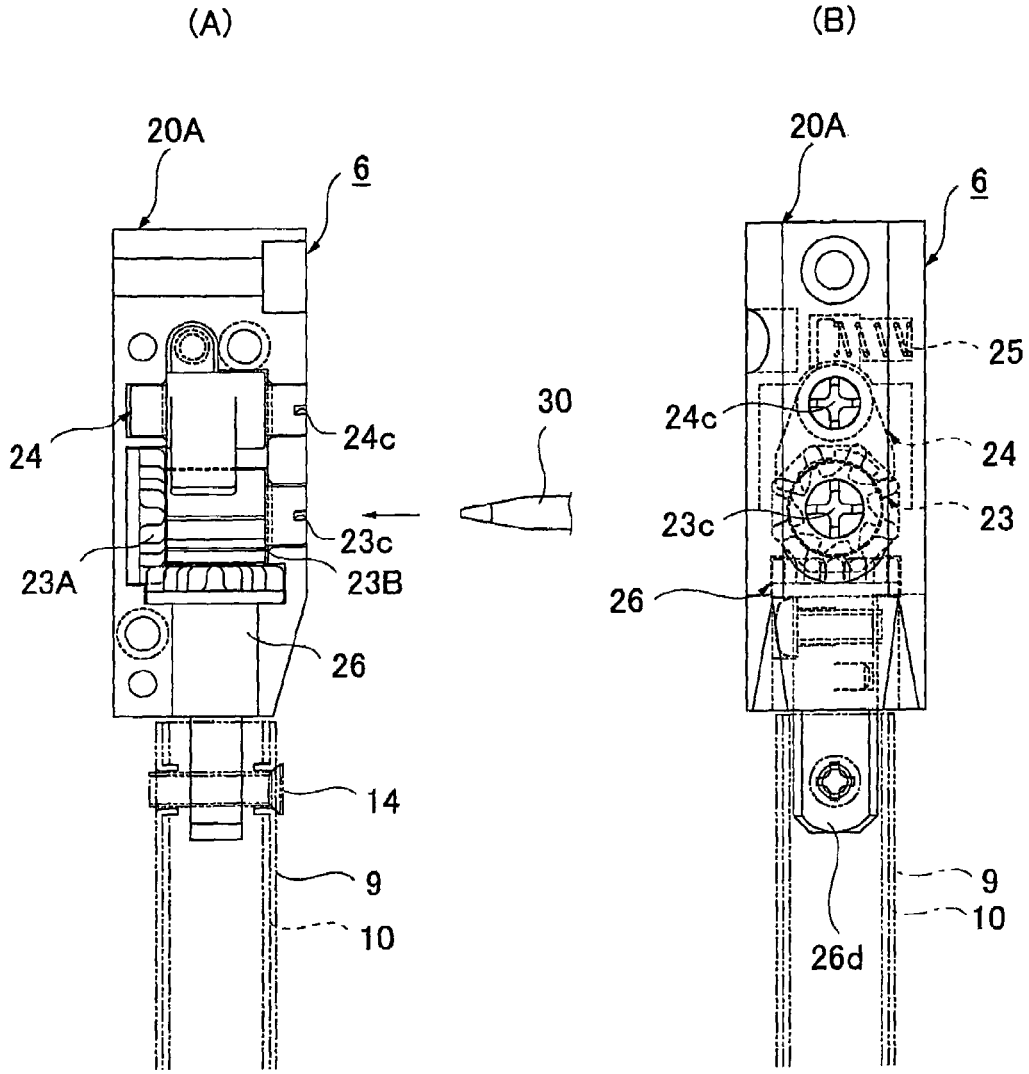
FIGS. 5A and 5B are respectively an enlarged half sectional view and an enlarged front view of a balancing force adjusting device 6.
Figure 6:
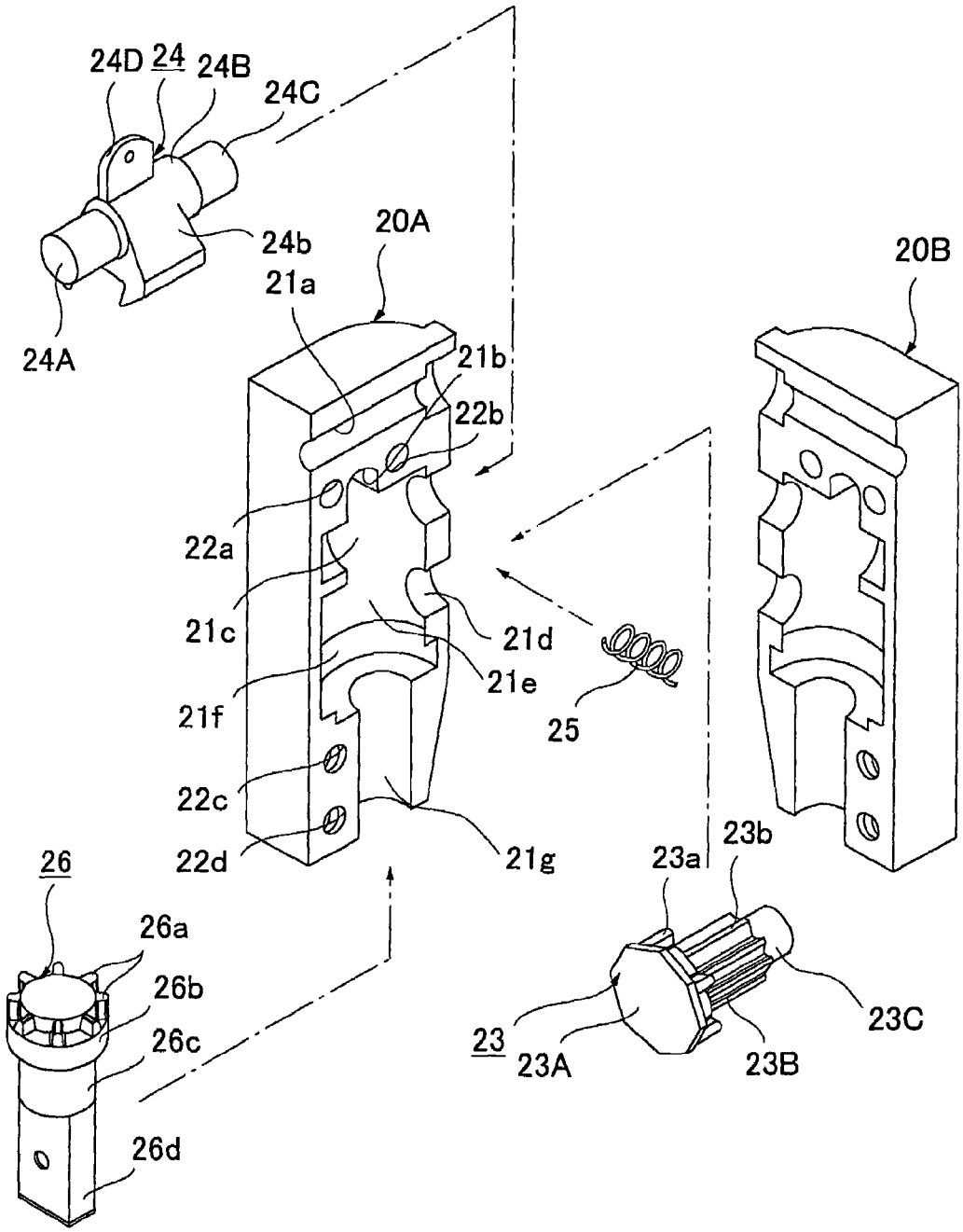
FIG. 6 is an exploded view of the balancing force adjusting device 6.
Figure 7:
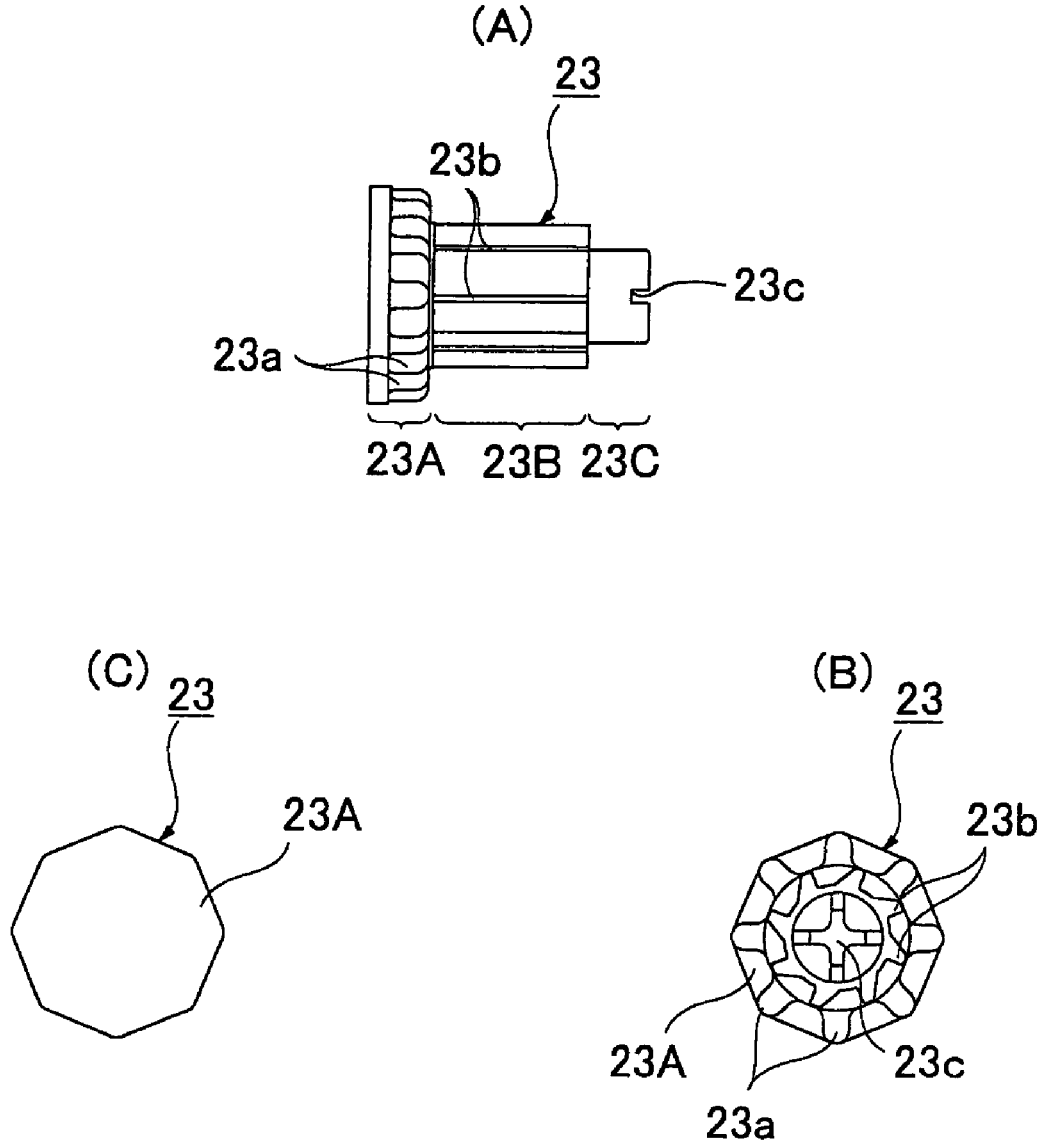
FIGS. 7A, 7B and 7C are respectively a side view, a front view and a bottom view showing a horizontal gear member 23.

As mainly shown in FIGS. 5 to 7, the above balancing force adjusting device 6 is constructed by a case 20, a horizontal gear member 23, a click member 24 and a vertical gear member 26. The case 20 stores respective constructional members therein. The horizontal gear member 23 is rotatably arranged around the horizontal axis in a predetermined position within this case 20. The click member 24 is arranged adjacently to a position above the above horizontal gear member 23 within the above case 20. The vertical gear member 26 is rotatably arranged around the vertical axis in a predetermined position within the above case 20. The vertical gear member 26 is dependently rotated by rotating the above horizontal gear member 23 by arranging the upper portion of this vertical gear member 26 so as to be engaged with a gear of the above horizontal gear member 23. A connecting shaft 26*d* of the above vertical gear member 26 projected to the downward side of the case 20 is inserted into the above torsion spring storing sleeve 9. This connecting shaft 26*d* and the torsion spring storing sleeve 9 are connected to each other by a connecting bolt 14 extended through and inserted into the torsion spring 10.

The above balancing force adjusting device 6 will next be described in detail on the basis of FIGS. 5 to 10. As shown in FIG. 6, the above case 20 has a half divisional structure. One side half divisional case piece 20A and the other side half divisional case piece 20B face each other, and are integrated with each other by screws screwed into screw holes 22*a* to 22*d*. The above half divisional case pieces 20A, 20B are set to symmetrical structures including fitting holes formed on the mating surface. Therefore, one side half divisional case piece 20A will next be explained.

An insertion hole 21*a* of a fixing screw is formed along the horizontal direction on the upper portion side of the mating surface of the above half divisional case piece 20A to fix the balancing force adjusting device 6 to the longitudinal frames 2A, 2B. A spring 25 is inserted into the lower side of this insertion hole 21*a*. Further, a first fitting hole 21*b* for the click member fitting a spring receiving portion 24D of the above click member 24 thereinto and having an inverted U-shape in section, and a second fitting hole 21*c* for the click member fitting the main body portion (intermediate shaft portion 24B) of the above click member 24 thereinto are continuously formed.

A first fitting hole 21*d* for a horizontal gear and a second fitting hole 21*e* for a horizontal gear are continuously formed in the horizontal direction to continuously fit the above horizontal gear member 23 onto the lower side of the above second fitting hole 21*c* for the click member along the horizontal direction. The first fitting hole 21*d* for the horizontal gear relatively has a small diameter and a semicircular shape in section, and a shaft end portion 23C of the above horizontal gear member 23 is fitted to the first fitting hole 21*d* for the horizontal gear. The second fitting hole 21*e* for the horizontal gear relatively has a large diameter and a semicircular shape in section, and the main body portion of the above horizontal gear member 23 is fitted to the second fitting hole 21*e* for the horizontal gear.

A first fitting hole 21*f* for a vertical gear and a second fitting hole 21*g* for a vertical gear are continuously formed in the vertical direction to fit the above vertical gear member 26 onto the lower sides of these fitting holes 21*d*, 21*e* for the horizontal gear along the vertical direction. The first fitting hole 21*f* for the vertical gear relatively has a large diameter and a semicircular shape in section, and a head portion 26*b* of the above vertical gear member 26 is fitted to the first fitting hole 21*f* for the vertical gear. The second fitting hole 21*g* for the vertical gear relatively has a small diameter and a semicircular shape in section, and a shaft portion 26*c* of the above vertical gear member 26 is fitted to the second fitting hole 21*g* for the vertical gear.

As shown in FIG. 7, the above horizontal gear member 23 is constructed by a head portion 23A, an intermediate shaft portion 23B and an end shaft portion 2C. Gears 23*a*, 23*a*, . . . are formed in the above head portion 23A along the circumferential direction. Ratchet gears 23*b*, 23*b* . . . are formed in the above intermediate shaft portion 23B along the circumferential direction. The above end shaft portion 2C is a shaft constituting a support shaft, and an inserting cross groove 23*c* of a driver (screwdriver) is formed on the tip face of the end shaft portion 2C. In an assembly state, the above shaft end portion 23C is fitted to the first fitting hole 21*d* for the horizontal gear in the case 20, and the above head portion 23A and the intermediate shaft portion 23B are fitted to the second fitting hole 21*e* for the horizontal gear.

Figure 8:
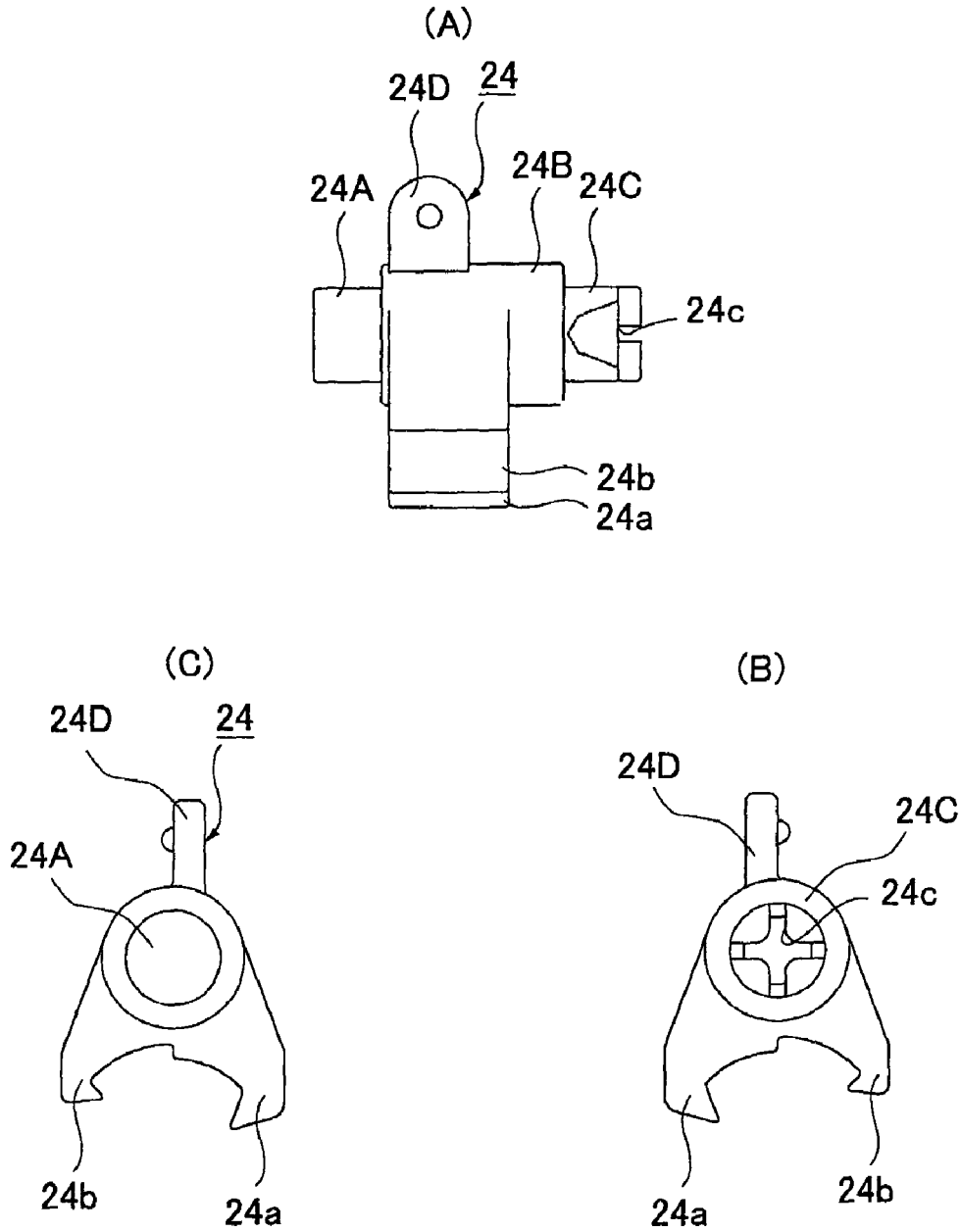
FIGS. 8A, 8B and 8C are respectively a side view, a front view and a rear view showing a click member 24.
Figure 9:
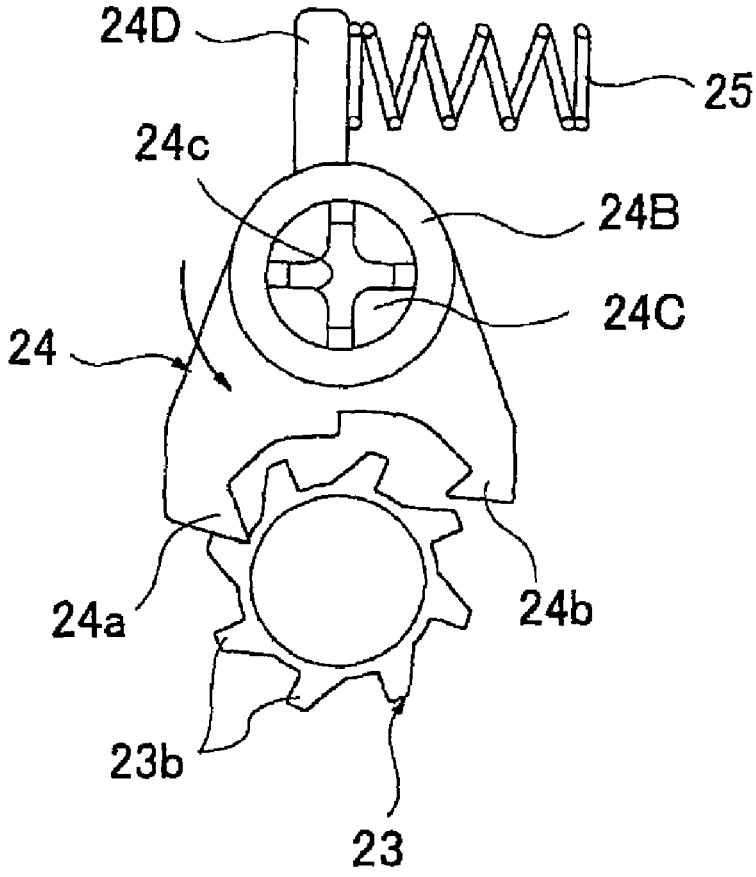
FIG. 9 is a view showing an engaging state of the horizontal gear member 23 and the click member 24.

In contrast to this, as shown in FIG. 8, the above click member 24 is constructed by end shaft portions 24A, 24C on both sides thereof, an intermediate shaft portion 24B, a spring receiving portion 24D integrally extended on the upper portion side of this intermediate shaft portion 24B, and a pair of left and right clicks 24*a*, 24*b* extended on the lower portion side of the above intermediate shaft portion 24B. An inserting cross groove 24*c* of a screwdriver is formed on the end face of the above end shaft portion 24C. In the assembly state, the above shaft receiving portion 24D is fitted to the first fitting hole 21*b* for the click member together with the spring 25, and the above intermediate shaft portion 24B is fitted to the above second fitting hole 21*c* for the click member. As shown in FIG. 9, the click 24*a* among the two clicks 24*a*, 24*b* extended on the horizontal gear member 23 side is engaged with the ratchet gear 23*b* of the horizontal gear member 23 by the biasing force of the spring 25.

Figure 10:
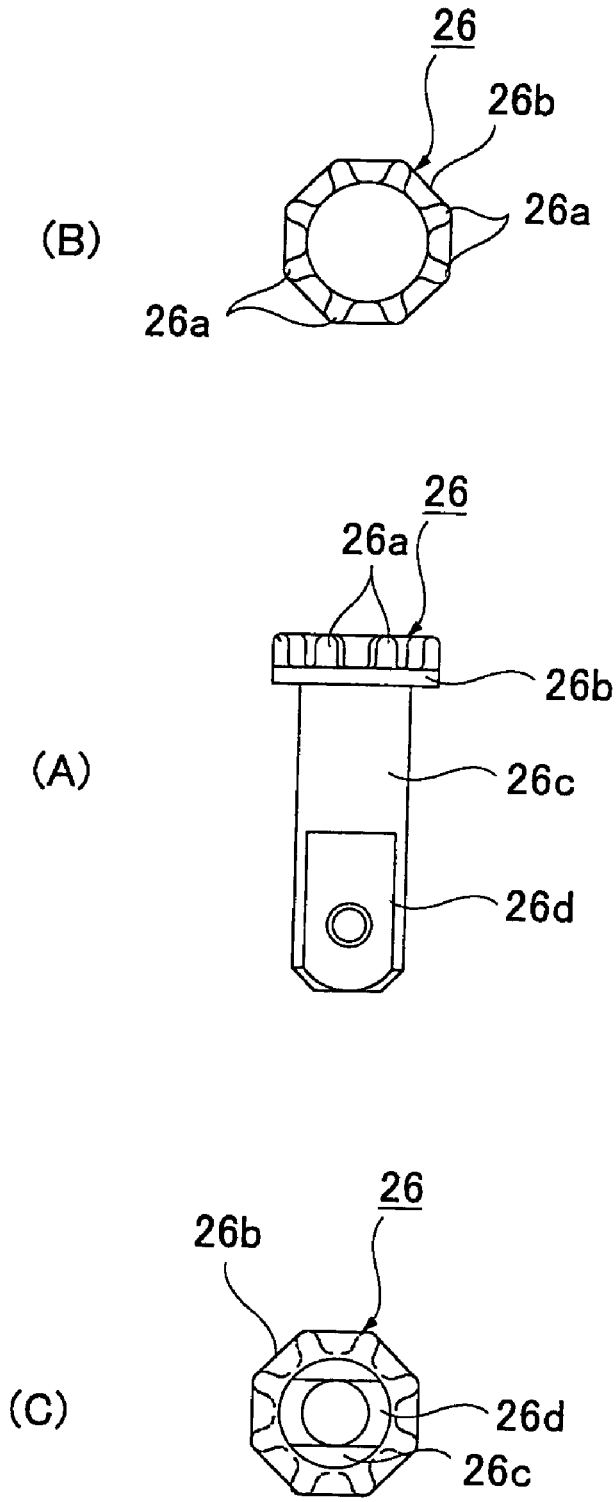
FIGS. 10A, 10B and 10C are respectively a side view, a plan view and a bottom view showing a vertical gear member 26.

On the other hand, as shown in FIG. 10, the above vertical gear member 26 is constructed by a head portion 26*b* having a gear 26*a* around its upper face side, a shaft portion 26*c* adjacent to this head portion, and a connecting shaft 26*d* continuously connected to this shaft portion 26*c*. The vertical gear member 26 is fitted to the fitting holes 21*f*, 21*g* for the vertical gear in the above case 20. The ratchet gear 23*b* of the above horizontal gear member 23 and the gear 26*a* of the above vertical gear member 26 are engaged with each other, and the rotation of the horizontal gear member 23 is transmitted to the vertical gear member 26. Thus, the vertical gear member 26 is dependently rotated around its axis.

When an initial torsional force is introduced with respect to the torsion spring 10 at an arranging time of the raising-lowering window 1 in the balancing force adjusting device 6 constructed as above, as shown in FIG. 5, the tip of the driver 30 is fitted to the inserting cross groove 23*c* of the above horizontal gear member 23. When the above horizontal gear member 23 is rotated rightward around the axis against the biasing force, this rotation is transmitted to the above vertical gear member 26 of an orthogonal arrangement, and the vertical gear member 26 is rotated around the axis. The torsion spring storing sleeve 9 and the torsion spring 10 are rotated in the winding direction of the above torsion spring 10 by the rotation of the connecting shaft 26*d* of the vertical gear member 26, and balancing force is given to the torsion spring 10.

When the above torsion spring 10 is conversely unfastened, the tip of the driver 30 is fitted to the inserting cross groove 24c on the tip face of the above click member 24. When the above click member 24 is rotated in the rightward direction, the engaging state of the click 24a and the ratchet gear 23*b* of the horizontal gear member 23 are released. However, since the other side click 24*b* is engaged with the above ratchet gear 23*b* in this case, the horizontal gear member 23 is rotated by one gear amount and is rested. Accordingly, the unwinding operation can be performed every one gear and the dropping of the shoji 3 can be also prevented by reciprocating and rotating the driver 30 in the left and right directions.

In the above mode example, the gear 23*a* of the horizontal gear member 23 and the gear 26*a* of the vertical gear member 26 orthogonally arranged are respectively formed on the orthogonal face, but the engaging faces can be respectively also set to conical faces as in a bevel gear. Further, since the balancing force generator 8 is suspended and supported by the balancing force adjusting device 6, the connecting shaft 26*d* of the vertical gear member 26 is connected together with the torsion spring storing sleeve 9 and the torsion spring 10, and the torsion spring storing sleeve 9 is also rotated together in addition to the torsion spring 10 by the rotation of the vertical gear member 26. However, for example, the torsion spring storing sleeve 9 may be separately supported and the above connecting shaft 26*d* and the torsion spring 10 may be connected to each other, and only the torsion spring 10 may be rotated by the rotation of the vertical gear member 26.

Further, the shoji 3 originally located on the lower stage side can be adjusted in the closing state (lowering state) of the shoji. In this case, no shoji 3 drops even when the torsion spring force is released at a stretch.

Therefore, the above click member 24 can be also set to the structure of only one side click 24*a* engaged with the ratchet gear 23b of the horizontal gear member 23 at all times.

Second Mode Example

In this second mode example, a device example in which a torsion spring adjusting mechanism in the present invention is assembled into a slide means arranged at the lower end of a side portion of the movable shoji will next be described in detail on the basis of FIGS. 11 and 12. Portions of the same functions as the first mode example are designated by the same reference numerals.

Figure 11:
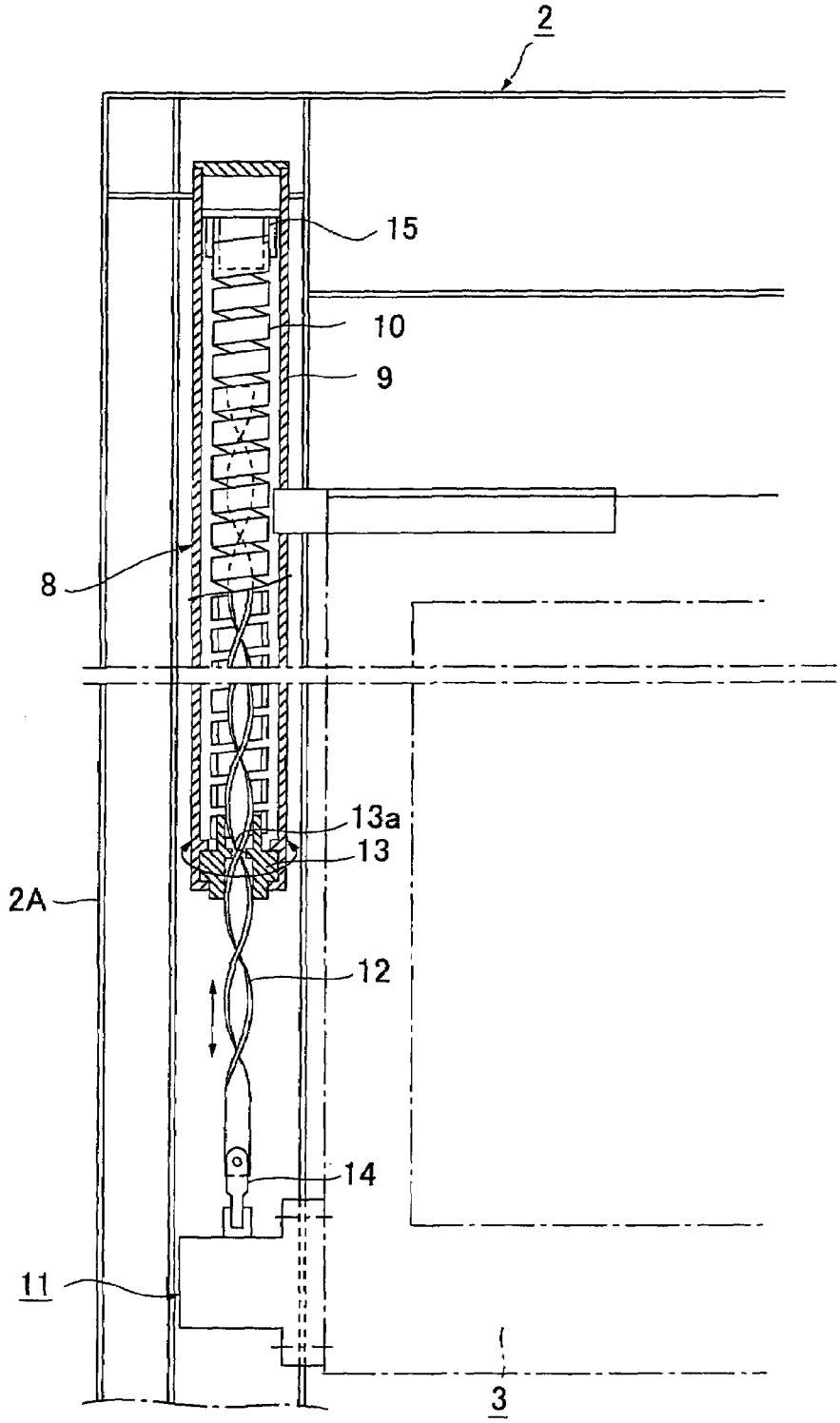
FIG. 11 is a longitudinal sectional view of a balancing device in accordance with a second mode example.

As shown in FIG. 11, a balancing device 5 is constructed by a torsion spring device 8 as a balancing means, a slide device 11, a spiral rod 12 and an adjusting means of the torsion spring. The torsion spring device 8 is fixedly arranged on the upper side of a longitudinal frame 2A (2B). The slide device 11 is connected to a lower rail side portion of the shoji 3, and is freely moved while the slide device 11 guides the shoji 3 along the longitudinal frame 2A (2B). The spiral rod 12 is connected to the above slide device 11 at its lower end, and is arranged in an arranging mode inserted into the torsion spring device 8 on its upper side so as to operate this slide device 11 and the above torsion spring device 8 in cooperation with each other. The spiral rod 12 performs the winding and unwinding operations of the torsion spring 10 arranged within the above torsion spring device 8 as the slide device 11 is moved. The adjusting means is assembled into the above slide device 11.

The above torsion spring device 8 has the torsion spring 10 obtained by processing a spring plate of a predetermined width in a spiral shape within the torsion spring storing sleeve 9 fixed within the longitudinal frame 2A in a vertical arrangement. The above torsion spring device 8 also has a rotating operating body 13 in its lower end portion. The rotating operating body 13 is rotated by a vertical movement of the above spiral rod 12 in the leftward and rightward directions in the same position. The above torsion spring storing sleeve 9 is a sleeve body approximately having a length corresponding to the stile of the shoji 3. The above torsion spring storing sleeve 9 has a fixed fitting 15 of the above torsion spring 10 in its upper end portion, and supports the torsion spring 10 in a suspending state. The lower end of the torsion spring 10 is connected to the upper portion of the above rotating operating body 13. This rotating operating body 13 is arranged in a lower end port portion of the torsion spring storing sleeve 9 so as to allow only the rotation around the vertical axis. A slit hole 13*a* corresponding to the sectional shape of the torsion spring 10 is formed in the central portion of the rotating operating body 13. When the above spiral rod 12 extending through this slit hole 13*a* is raised and lowered as the shoji 3 is vertically moved, the above rotating operating body 13 is guided by the torsional face of the spiral rod 12 and is rotated so that the torsion spring 10 is wound or unwound. In reality, as the above spiral rod 12 is lowered, the rotating operating body 13 is rotated in the winding direction so that the torsion spring 10 is wound and fastened. As the shoji 3 is raised, the rotating operating body 13 is rotated in the opposite direction so that the torsion spring 10 is unwound. Accordingly, when a balancing torsional force is given to the above torsion spring 10 in advance in a maximum raising position of the shoji 3, the torsion spring 10 balances with the shoji 3 even when the shoji 3 is located in any raising-lowering position. Thus, the shoji can be rested in an arbitrary opening position. Further, since forces are balanced in the vertical direction, the shoji can be raised and lowered and operated by slight force.

Figure 12:
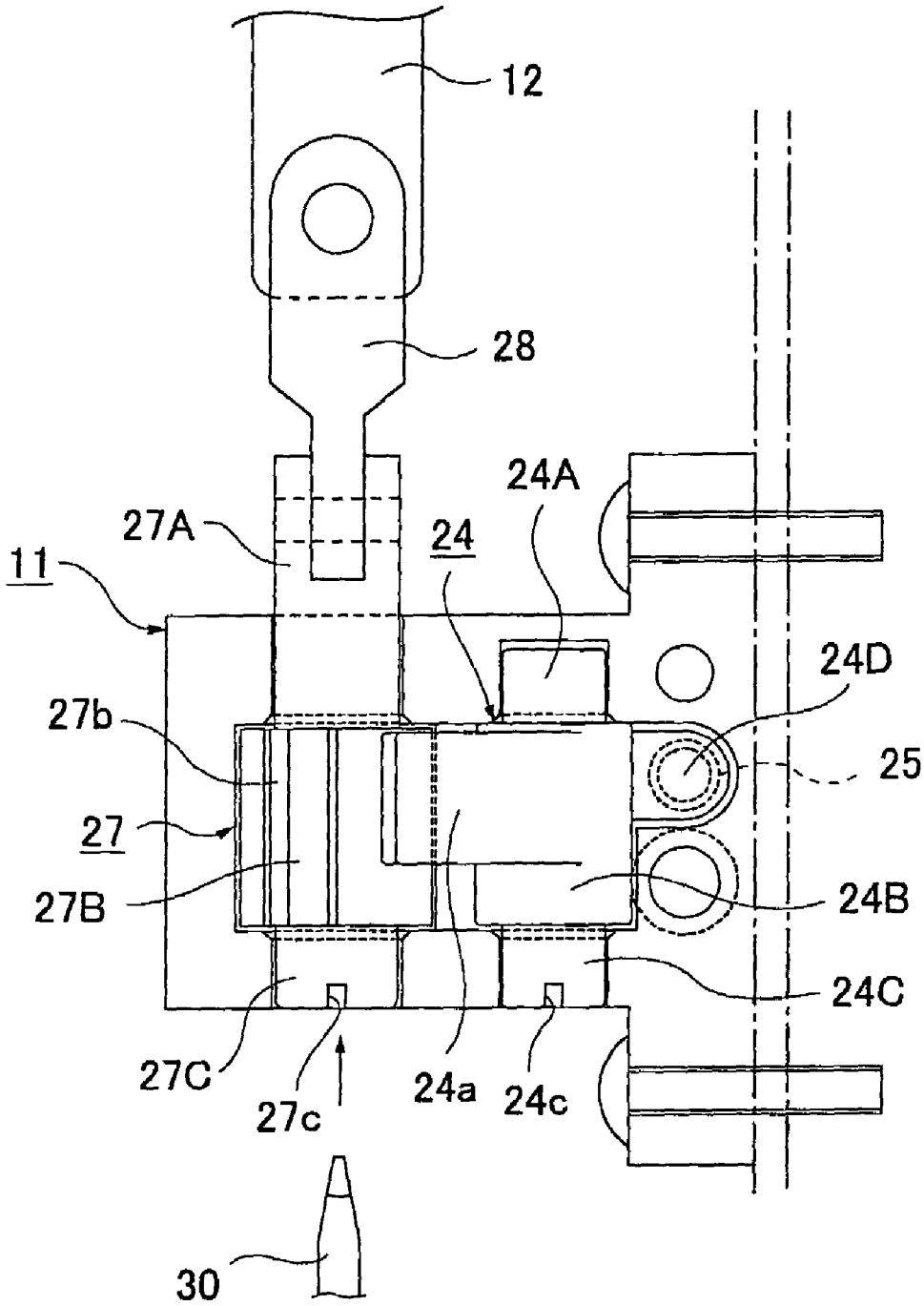
FIG. 12 is an enlarged sectional view of a portion of a slide device 11.

As shown in FIG. 12, the torsion spring adjusting mechanism is assembled into the above slide device 11. This torsion spring adjusting mechanism is constructed by a ratchet shaft member 27 rotatably arranged around the vertical axis in a predetermined position, and a click member 24 rotatably arranged in a predetermined angular range around the vertical axis in an adjacent position of this ratchet shaft member 27.

The above ratchet shaft member 27 is constructed by a connecting shaft member 27A connected to the spiral rod 12 through a connecting metallic material 28, an intermediate shaft portion 27B forming ratchet gears 27*b*, 27*b*, - - - therearound, and an end shaft portion 27C. An inserting cross groove 27*c* of a driver (screwdriver) is formed on the tip face of the above end shaft portion 27C.

On the other hand, the above click member 24 is the same member as the above first mode example. This click member 24 is constructed by end shaft portions 24A, 24C on both sides thereof, an intermediate shaft portion 24B, a spring receiving portion 24D integrally extended on the upper portion side of this intermediate shaft portion 24B, and a pair of left and right clicks 24*a*, 24*b* extended on the lower portion side of the above intermediate shaft portion 24B. An inserting cross groove 24*c* of a screwdriver 30 is formed on the end face of the above end shaft portion 24C.

In an assembly state, the click 24*a* among the two clicks 24*a*, 24*b* extended on the ratchet shaft member 27 side is engaged with the ratchet gear 27*b* of the ratchet shaft member 27 by the biasing force of a spring 25.

In such a torsion spring adjusting mechanism, when an initial torsional force is introduced with respect to the torsion spring 10 at the arranging time of a raising-lowering window 1, the tip of the driver 30 is fitted to the inserting cross groove 27*c* of the above ratchet shaft member 27. When the above ratchet shaft member 27 is then rotated around the axis against the biasing force, the spiral rod 12 is rotated in the winding direction, and balancing force is given to the torsion spring 10.

When the above torsion spring 10 is reversely unfastened, the tip of the driver 30 is fitted to the inserting cross groove 24*c* on the tip face of the above click member 24. When the above click member 24 is rotated in the rightward direction, the engaging state of the click 24*a* and the ratchet gear 27*b* of the ratchet shaft member 27 is released. However, since the other side click 24*b* is engaged with the above ratchet gear 27*b* in this case, the ratchet shaft member 27 is rotated by one gear amount and is rested. Accordingly, the unwinding operation can be performed every one gear by reciprocating and rotating the driver 30 in the leftward and rightward directions, and the dropping of the shoji 3 can be also prevented.

As mentioned above in detail, in accordance with the present invention, the balancing device can be set to a compact structure simply assembled. Further, after the balancing device is adjusted, the winding and unwinding adjustments can be simply made without generating slackness, a slip, etc. at all, and a stepwise adjustment can be made with respect to the unwinding operation as well as the winding operation.

What is claimed is:

1. A balancing device of a raising-lowering window arranged in a movable shoji opened and closed in the vertical direction, and holding a dynamic balancing relation with the weight of the movable shoji and resting the movable shoji in an arbitrary position and facilitating the opening and closing operations, wherein said balancing device comprises a balancing force adjusting device, a balancing force generator, a slide body, and a spiral rod, wherein the balancing force adjusting device is fixedly arranged in an upper portion position of a longitudinal frame and comprises a case, a horizontal gear member, a click members, and a vertical gear member, wherein the horizontal gear member is rotatably arranged around a horizontal axis in a predetermined position within the case and a gear is formed on a side of a head portion of the horizontal gear member, and a ratchet gear is formed around an intermediate shaft portion of the horizontal gear member, and a screwdriver engaging portion is formed on an end face of the horizontal gear member facing the case exterior, wherein the click member is rotatably arranged in a predetermined angular range around a horizontal axis in a position adjacent to said horizontal gear member, and a screwdriver engaging portion is formed on an end face of the click member facing the case exterior, and two clicks extending in said horizontal gear member direction are respectively arranged on a lower portion of a click member intermediate shaft portion within the case, and one of said clicks is biasedly engaged with the ratchet gear formed around the intermediate shaft portion of said horizontal gear member, and the other click is engaged with the ratchet gear when the engagement of the one click is released by a swinging operation, and wherein the vertical gear member is rotatably arranged around a vertical axis in a predetermined position within said case, and a gear around the upper face side of the vertical gear member is engaged with the gear around the head portion of said horizontal gear member, and a connecting shaft is arranged in a lower end portion of the vertical gear member, the vertical gear member being dependently rotated by rotating said horizontal gear member, wherein the balancing force generator comprises a torsion spring storing sleeve, a torsion spring stored within the torsion spring storing sleeve, and a rotating operating body arranged in a lower end portion of the torsion spring, the balancing force generator being connected to the vertical gear member of said balancing force adjusting device and being arranged in a vertical arrangement, and at least the torsion spring being rotated and operated around a vertical axis by an adjusting operation in the balancing force adjusting device so that balancing force can be introduced and adjusted with respect to the torsion spring and an upper direction force balancing with the movable shoji being given by said torsion spring at the opening and closing times of the movable shoji, wherein the slide body is fixedly arranged in a lower end side portion of said movable shoji, and is raised and lowered as the movable shoji is vertically moved, and wherein a lower end of the spiral rod is fixed to the slide body, and an upper end of the spiral rod extends through the rotating operating body of said balancing force generator and is inserted into the torsion spring storing sleeve, and the spiral rod performs winding and unwinding operations of the torsion spring by giving rotating force around a vertical axis to said rotating operating body as said movable shoji is vertically moved.

2. A balancing device of a raising-lowering window arranged in a movable shoji opened and closed in the vertical direction, and holding a dynamic balancing relation with the weight of the movable shoji and resting the movable shoji in an arbitrary position and facilitating the opening and closing operations, wherein said balancing device comprises balancing means for giving an upper direction force balancing with said movable shoji by a torsion spring, slide means attached to a side portion lower end of the movable shoji and guiding the movable shoji along a longitudinal frame while guiding the movable shoji, a spiral rod for operating the slide means and said balancing means in cooperation with each other and performing winding and unwinding operations of the torsion spring of said balancing means as the slide means is moved, and adjusting means of said torsion spring assembled into said slide means, wherein said torsion spring adjusting means is constructed by a ratchet shaft member and a click member, wherein the ratchet shaft member is rotatably arranged around a vertical axis in a predetermined position, and a connecting portion connected to said spiral rod is arranged in an upper end portion of the ratchet shaft member, and a ratchet gear is formed around a shaft portion of the ratchet shaft member, and a screwdriver engaging portion is formed on a lower end face of the ratchet shaft member facing the exterior, and wherein the click member is rotatably arranged in a predetermined angular range around a vertical axis in a position adjacent to said ratchet shaft member, and a screwdriver engaging portion is formed on a lower end face of the click member facing the exterior, and two clicks extending in said ratchet shaft member direction are respectively arranged on either side of a click member intermediate shaft portion, and one of said clicks is biasedly engaged with the ratchet gear formed around said ratchet shaft member, and the other click is engaged with the ratchet gear when the engagement of the one click is released by a swinging operation.

3. A balancing device for a shoji to counterbalance the weight of the shoji, comprising:

a balancing force adjusting device connected to the shoji and having a case, a horizontal gear member, a ratchet member, and a vertical gear member; and a balancing force generator for applying force to counterbalance the shoji, said force being adjustable by a torque applied by said balancing force adjusting device;

said horizontal gear member being rotatably arranged within the case and having a horizontal gear member gear, a ratchet gear, and an first exposed engagement element engageable to permit rotation thereof by external force, the ratchet member being rotatably arranged in a position adjacent to said horizontal gear member and having a second exposed engagement element engageable to permit rotation thereof by external force and at least one ratchet arm biasedly engaged with the ratchet gear to restrict rotation of the horizontal gear member in a first direction which reduces the torque applied to the balancing force generator, the vertical gear member being rotatably arranged within said case and having a vertical gear member gear engaged with the horizontal gear member gear, and being connected to the balancing force generator to apply torque from the horizontal gear member to said balancing force generator to adjust the force applied to counterbalance the shoji, wherein said first exposed engagement element is rotatable by an external force in a second direction opposite said first direction, to adjust torque applied to the balancing force generator, and said second exposed engagement element is engageable to release the restricting action of the ratchet arm.

4. The balancing device according to claim 3 wherein the balancing force generator comprises:

a torsion spring storing sleeve;

a torsion spring; and a rotating operating body arranged in an end portion of the torsion spring, at least the torsion spring being rotatable around an axis by an adjusting operation in the balancing force adjusting device.

5. The balancing device according to claim 4, further comprising:

a spiral rod connected to the shoji and extending through said rotating operating body and inserted into said torsion spring storing sleeve, said spiral rod performing winding and unwinding operations of the torsion spring by applying rotating force around a vertical axis to said rotating operating body as said movable shoji is vertically moved.

6. A balancing device according to claim 3, wherein the at least one ratchet arm includes a first and a second ratchet arm, the first ratchet arm being biasedly engaged with the ratchet gear to restrict rotation of the horizontal gear member in said first direction which reduces the torque applied to the balancing force generator, and the second ratchet arm being engaged with the ratchet gear to restrict the rotation of the horizontal gear in said first direction when the restrictive action of the first rachet arm is released.

7. A balancing device according to claim 3, wherein said first and second exposed engagement elements are engageable by a screwdriver.

8. A balancing device for a shoji to counterbalance the weight of the shoji, comprising:

a torsion spring adjusting means having a gear member and a ratchet member, a balancing means for applying an upper direction force to balance the weight of the shoji and being connected to the shoji, said force being adjustable by a torque applied by the torsion spring adjusting means, said gear member being rotatably arranged and having a ratchet gear and a first exposed engagement element engageable to permit rotation thereof by external force, said ratchet member being rotatably arranged adjacent to said gear member and having a second exposed engagement element engageable to permit rotation thereof by external force and at least one ratchet arm biasedly engaged with said ratchet gear to restrict rotation of the gear member in a first direction which reduces the torque applied to the balancing force generator, wherein said first exposed engagement element is rotatable by an external force in a second direction opposite said first direction, to adjust torque applied to the balancing force generator, and said second exposed engagement element is engageable to release the restricting action of the ratchet arm.

9. A balancing device according to claim 8 further comprising:

slide means attached to said shoji; and a spiral rod connected to said slide means, the balancing means having a torsion spring, the torsion spring adjusting means being assembled into said slide means, and said gear member being rotatably arranged connected to said spiral rod.

10. A balancing device according to claim 8, wherein the at least one ratchet arm includes a first and a second ratchet arm, the first ratchet arm being biasedly engaged with the ratchet gear to restrict rotation of the gear member in said first direction which reduces the torque applied to the balancing means, and the second ratchet arm being engaged with the ratchet gear to restrict the rotation of the gear member in said first direction when the restrictive action of the first rachet arm is released.

11. A balancing device according to claim 8, wherein said first and second exposed engagement elements are engageable by a screwdriver.

* * * * *